US005147703A

United States Patent [19]

Provost et al.

[11] Patent Number: 5,147,703

[45] Date of Patent: Sep. 15, 1992

[54] GOLF TOWEL SET

[76] Inventors: Jack Provost, P.O. Box 1063; Kenneth Martin, 25 Hickory Rd., Apt. B2,, both of Chatham, N.J. 07928

[21] Appl. No.: 688,867

[22] Filed: Apr. 22, 1991

[51] Int. Cl.[5] ..... A47K 10/02; A47K 10/12

[52] U.S. Cl. ..... 428/82; 428/85; 428/99; 428/100; 428/102; 428/124; 428/126; 15/209.1; D6/608; 273/32 B

[58] Field of Search ..... 428/81, 82, 88, 99, 428/100, 85, 102, 124, 126, 130; 15/209 R; 273/32 B; D6/608

[56] References Cited

U.S. PATENT DOCUMENTS 2,754,532 7/1956 Kanehl et al. ..... D6/608

4,912,800 4/1990 Zeltner ..... 15/210 R

*Primary Examiner*—Alexander S. Thomas

*Attorney, Agent, or Firm*—Thomas L. Adams

[57] ABSTRACT

A golf towel set is adapted for attachment to a golf bag or other article. The golf towel has a main towel and an accessory towel. The accessory towel is releasably attached to the main towel. A fastener can attach the main towel to the golf bag or other article.

18 Claims, 1 Drawing Sheet

GOLF TOWEL SET

BACKGROUND OF THE INVENTION

The present invention relates to golf towels, and in particular, to towels that can be fastened to a golf bag or other article.

Golfers often fasten a towel to their golf bag or golf cart. The towel can be used to clean the face of a golf club. The towel is large enough to clean the larger clubs such as irons and woods. The golfer will often want to clean his putter and ball after reaching the green. Since the green is off limits to a golf cart and bag, a towel fastened to them is inconvenient.

Known golf towels include a grommet that can be used with a clip or chain to attach the towel to a golf bag or cart. Other golf towels employ a strap that can be closed on itself to form a loop by which the towel is similarly attached to the golf bag or cart. The loop can be formed by various fasteners such as a Velcro TM fastener.

U.S. Pat. No. 4,625,862 shows a badge attached to a golf bag. The badge has a Velcro patch for holding various devices including a towel. U.S. Pat. No. 4,403,366 shows a folded towel having an upper flap with a Velcro patch. This patch attaches to a mating Velcro strip on a belt clip. U.S. Pat. No. 4,516,616 shows a golf towel shielded by a plastic hood. The towel and hood are connected together by a Velcro fastener so the towel can be removed. See also U.S. Pat. Nos. 3,185,197; 3,760,461; 4,698,854; 4,747,399; 4,768,236; 4,771,478; and 4,912,800.

A disadvantage with all of these known towels and related devices is the failure to provide a golf towel that is easily detached and used on the green. The towel should be able to clean both putters and golf balls; be easily carried on a golf bag or cart; yet readily transportable onto a putting green.

Accordingly, there is a need for an improved golf towel that is adaptable for cleaning various clubs and golf balls, and can be transported as noted above.

SUMMARY OF THE INVENTION

In accordance with the illustrative embodiments demonstrating features and advantages of the present invention, there is provided a golf towel adapted for attachment to a golf bag or other article. The golf towel has a main towel and a fastening means for attaching the main towel to the golf bag or other article. Also included is an accessory towel releasably attached to the main towel.

In a preferred embodiment, a square towel is oriented with two opposing corners aligned vertically, that is, in a diamond orientation. The top corner is folded down to provide a relatively small right isosceles triangle, whose hypotenuse is then doubly folded by two chief folds that form the towel into a relatively compact and flared main towel. This main towel can have an upper strap with a Velcro fastener to allow closing of the strap into a loop for the purpose of attaching the main towel to a golf bag or cart.

An accessory towel of approximately one fourth the area of the main towel is similarly folded. A Velcro patch is stitched at the top corner of the accessory towel. A complementary Velcro patch on the main towel adjacent to the fastening strap allows a golfer to attach the accessory towel to the main towel.

The main towel can be used in the normal fashion for cleaning woods and irons. When the golfer wishes to travel to the green, the accessory towel can be removed from the main towel and placed in a pocket. This smaller towel is convenient because of its size and is appropriate for the relatively light cleaning job associated with cleaning a putter head and ball. The smaller towel can be wetted to make it more effective at cleaning the ball.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF THE PREFERRED EMBODIMENTS

Figures 1, 2, 3, 4, 5, 6:
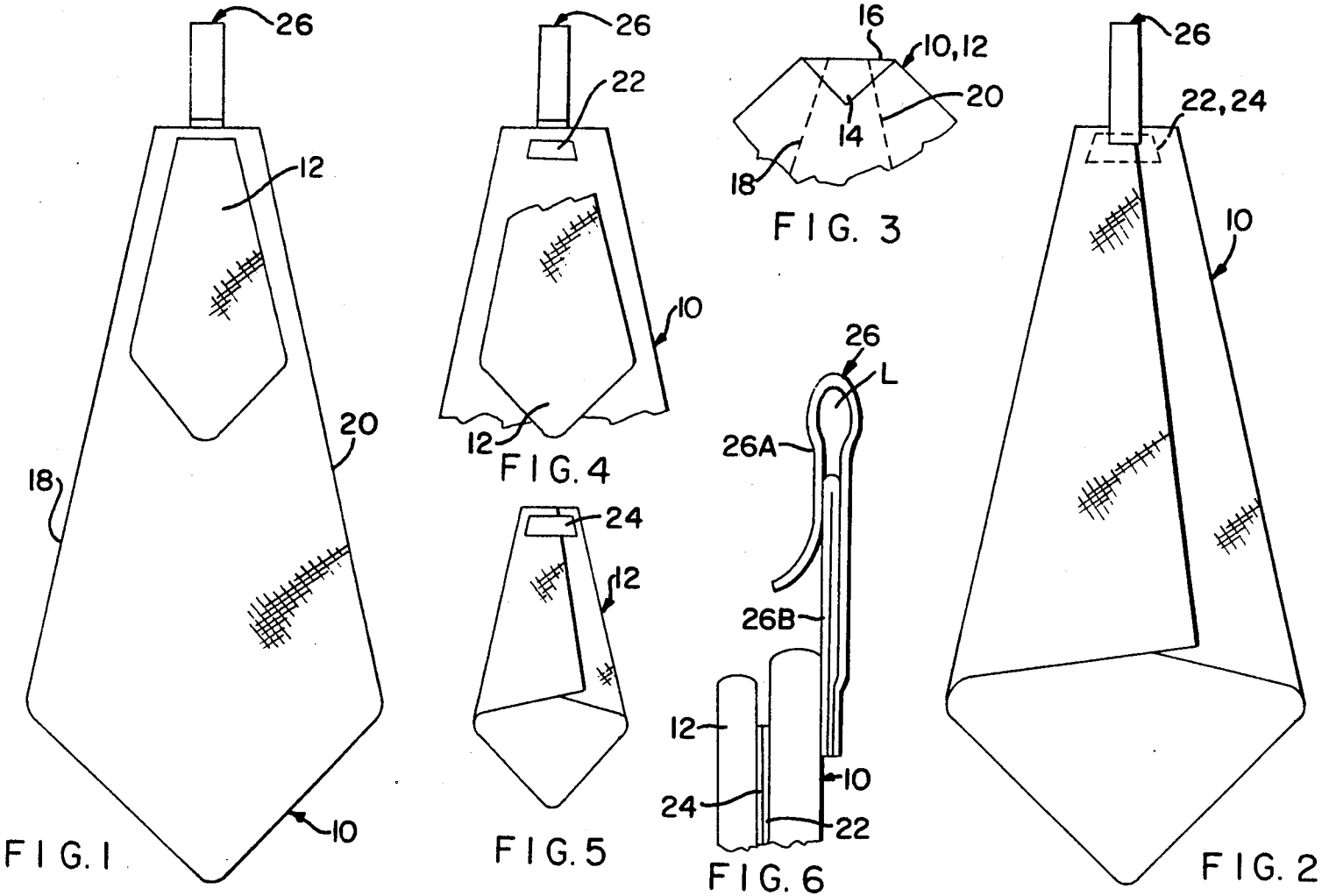
FIG. 1 is front view of a golf towel in accordance with the principles of the present invention.
FIG. 2 is a rear view of the golf towel of FIG. 1.
FIG. 3 is a development showing the folding of the main and accessory towels of FIG. 1.
FIG. 4 is a front view of the golf towel of FIG. 1 with the lower portion and upper portion of the main and accessory towel, respectively, cut away for illustrative purposes.
FIG. 5 is a rear view of the accessory towel of FIG. 1.
FIG. 6 is a side view of the upper portion of the golf towel of FIG. 1.

Referring to FIGS. 1–4, a golf towel is shown employing a main towel 10 and an accessory towel 12. Towels 10 and 12 can be made of terry cloth or similar absorbent materials that are tough enough to clean the head of a golf club. In a constructed preferred embodiment, towels 10 and 12 were 20 and 10 inches square, respectively.

Towels 10 and 12 are similarly folded much like a shirt tie. In FIG. 3, the upper corner of towels 10 or 12 schematically illustrated. The upper corner 14 is folded down at a central fold 16 to form the illustrated right isosceles triangle. Chief folds 18 and 20 are angularly spaced at 30° or greater, and preferably 40°, although other angles can be used instead. The folds can be held by stitching, described presently.

Towel 12 can attached to main towel 10 by means of clips, snaps, ties and various other fastening devices. In the illustrated embodiment, however, a Velcro fastener is used. In FIG. 4, a binding pad 22 having a trapezoidal shape is stitched to the main towel 10. By stitching pad 22, the illustrated folds in main towel 10 are simultaneously held in place near the top corner of towel 10 (hereinafter referred to as the first one of the corners of towel 10). The chief folds 18 and 20 allow the main towel 10 to take the compact shape illustrated. Being only stitched at the upper corner, however, main towel 10 can be almost fully unfolded and used in the usual fashion.

A complementary pad 24, illustrated in FIG. 5, is attached to the upper corner of towel 12 (hereinafter referred to as the primary one of the corners of towel 12). Pad 24 is again trapezoidal and is sized to mate with previously mentioned pad 22 (FIG. 4). Pad 24 is stitched to accessory towel 12 along its perimeter, thereby holding the fold at the top corner of towel 12, but yet letting the lower part of the towel 12 to unfold and be used in the usual fashion.

Pads 22 and 24 are the usual Velcro pads having a looped pile on one surface and a hooked pile on the other surface designed to adhere to the complementary pad. It will be appreciated, of course, that pads 22 and 24 can be reversed and that in some embodiments alternate attachment devices such as snaps, clips, strings etc. can be used instead.

A fastening means 26 is shown stitched to the upper corner of main towel 10. Fastening means 26 as illustrated best in FIG. 6 comprises a strap 26A that is part of a Velcro fastener. In one constructed embodiment, strap 26A has on its inside face a looped pile. Folded in half and stitched directly to the rear face of towel 10, is a strap 26B. In this embodiment, strap 26B is also part of a Velcro fastener and has a hooked pile designed to adhere to the pile of strap 26A. Strap 26A is stitched together with strap 26B to the rear face of towel 10 as illustrated.

Accordingly, strap 26A can be lifted away from strap 26B and repositioned to form a loop L of various sizes. The strap 26A can be routed through a grommet, ring or other part of a golf bag or cart, and then secured to strap 26B to form the loop L.

The stitching that secures pad 22 to towel 10 can be the same stitching that holds straps 26A and 26B to towel 10. Stitching is not mandatory, however, and other techniques can be used such as gluing, riveting etc. Furthermore, the stitching can extend downwardly on the towel beyond the perimeter of pad 22. Such extended stitching can be useful in maintaining the upper part of towel 10 closed together in light of the high forces applied to it when cleaning larger items such as a wood.

To facilitate an understanding of the principles associated with the foregoing golf towel, its use will be described in connection with FIGS. 1 and 6. Initially, the golf towel as illustrated in FIG. 1 can be attached to a golf bag or cart using fastener 26 in the manner previously described. Specifically, strap 26A (FIG. 6) can be lifted from strap 26B and threaded through a grommet, ring or other structure on golf bag or cart. Thereafter, strap 26A is closed on strap 26B to hold golf towel 10 in place. During play the golfer can use towel 10 in the usual fashion to dry his hands, or to clean dirty club heads. While main towel 10 is dry, accessory towel 12 can be wetted to enhance cleaning. Towel 12 can clean the golf ball or the heads of the clubs, irons and putter. Also, towel 12 can dampen and clean the grips of the clubs, irons and putter.

When the golfer reaches the green, he can pull towel 12 off of the main towel by disconnecting the pads 22 and 24. Then the golfer can insert the upper end of towel 12 into a rear pocket and then walk to the green. The upper end of towel 12 is made sufficiently narrow to be conveniently insertable into a pocket. The length of the accessory towel 12 is such that it does not unduly hang and interfere with the golfer's mobility or appearance. The accessory towel 12 arches away from the golfer's clothing, which is especially helpful when towel 12 is wet.

On the green, the golfer can remove the accessory towel 12 from his or her pocket and clean the golf ball, or the head and grip of a putter. Thereafter, the towel can be replaced in the golfer's pocket. After putting and walking off the green, the golfer can return to his golf bag or cart and very quickly replace accessory towel 12 on main towel 10.

It is to be appreciated that various modifications may be implement with respect to the above described preferred embodiments. For example, the size and shape of the main and accessory towels can be altered. The towels need not be square, but can be rectangular, triangular, or other shapes. Furthermore, the fastening means need not be a strap with a Velcro fastener, but may include clips, chains, snaps or other types of devices that would be useful in attaching a towel to a golf bag, golf cart or other article. Additionally, the manner in which the folding occurs can be altered and the unfolded sides of the towel can be kept vertical and horizontal so that the folded towel has a more rectangular, unflared appearance. Similarly, the manner of fastening the accessory towel to the main towel can be varied and various snaps, clips, ties and other attaching devices can be used instead. Moreover, the size and dimension of the various towels can be altered depending upon the preferences of the golfer; although it is preferred to keep the accessory towel at a suitably small size to allow easy insertion in a golfer's pocket.

Obviously many modifications and variations of the present invention are possible in light of the above teachings. It is therefore to be understood that within the scope of the appended claims, the invention may be practiced otherwise than as specifically described.

We claim:

1. A golf towel adapted for attachment to a golf bag or other article, comprising:

a main towel;

a fastening means for attaching said main towel to said golf bar or other article; and an accessory towel releasably attached to said main towel.

2. A golf towel according to claim 1 wherein said accessory towel is smaller than said main towel.

3. A golf towel according to claim 2 wherein said accessory towel has less than half the area of said main towel.

4. A golf towel according to claim 2 wherein said main and said accessory towel are rectangular, said fastening means being attached to said main towel at a first one of its corners.

5. A golf towel according to claim 4 wherein said accessory towel is attached by a primary one of its corners to said main towel near said fastening means.

6. A golf towel according to claim 5 wherein said main towel is doubly folded and stitched at said first one of said corners to maintain double folding of said main towel.

7. A golf towel according to claim 6 wherein said accessory towel is doubly folded and stitched at said primary one of said corners to maintain double folding of said accessory towel.

8. A golf towel according to claim 7 wherein said fastening means is a strap with an end having means to hold said strap in a loop.

9. A golf towel according to claim 8 further comprising:

a binding pad attached at said first one of said corners of said main towel; and a complementary pad attached at said primary one of said corners of said accessory towel and adapted to releasably adhere to said binding pad, so that said accessory towel is releasably secured to said main towel.

10. A golf towel according to claim 9 wherein said accessory towel and said main towel are folded to place the accessory towel completely within the silhouette of said main towel when said accessory towel is attached to said main towel by said binding pad and said complementary pad.

11. A golf towel according to claim 10 wherein said main and said accessory towels each have a spaced pair of chief folds diverging away from said binding pad and said complementary pad, respectively, so that said main and said accessory towels have a downward flare when attached together and hung from said fastening means.

12. A golf towel according to claim 11 wherein said first and said primary corners have opposite each a central fold defining a right triangular section, the chief folds being across and doubly dividing the hypotenuse of said right triangular section.

13. A golf towel according to claim 5 wherein said accessory towel is folded and sized to make its primary one of said corners pocket-sized.

14. A golf towel according to claim 13 wherein said main towel is doubly folded and stitched at said first one of said corners to maintain double folding of said main towel and wherein said accessory towel is doubly folded and stitched at said primary one of said corners to maintain double folding of said accessory towel.

15. A golf towel according to claim 14 further comprising:

a binding pad attached at said first one of said corners of said main towel; and a complementary pad attached at said primary one of said corners of said accessory towel and adapted to releasably adhere to said binding pad, so that said accessory towel is releasably secured to said main towel.

16. A golf towel according to claim 15 wherein said accessory towel and said main towel are folded to place the accessory towel completely within the silhouette of said main towel when said accessory towel is attached to said main towel by said binding pad and said complementary pad, said main and said accessory towels each have a spaced pair of chief folds diverging away from said binding pad and said complementary pad, respectively, so that said main and said accessory towels have a downward flare when attached together and hung from said fastening means.

17. A golf towel according to claim 16 wherein said first and said primary corners have opposite each a central fold defining a right triangular section, the chief folds being across and doubly dividing the hypotenuse of said right triangular section.

18. A golf towel adapted for attachment to a golf bag or other article, comprising:

a square main towel doubly folded and stitched at a first one of its corners to maintain double folding of said main towel;

a fastening means attached to said main towel at said first one of its corners for attaching it to said golf bag or other article, said fastening means including a strap with an end having means to hold said strap in a loop;

a square accessory towel attached by a primary one of its corners to said main towel near said fastening means, said accessory towel being doubly folded and stitched at said primary one of its corners to maintain double folding of said accessory towel, said accessory towel being folded and sized to make said primary one of its corners pocket-sized, said accessory towel having less than half the area of said main towel and being releasably attached to said main towel;

a binding pad attached at said first one of said corners of said main towel; and a complementary pad attached at said primary one of said corners of said accessory towel and adapted to releasably adhere to said binding pad, so that said accessory towel is releasably secured to said main towel, said main and said accessory towels each having a spaced pair of chief folds diverging away from said binding pad and said complementary pad, respectively, so that said main and said accessory towels have a downward flare when attached together and hung from said fastening means, placing the accessory towel completely within the silhouette of said main towel, said first and said primary corners having opposite each a central fold defining a right triangular section, the chief folds being across and doubly dividing the hypotenuse of said right triangular section.

* * * * *